United States Patent [19]

Rohner

[11] Patent Number: 4,466,226

[45] Date of Patent: Aug. 21, 1984

[54] METHODS OF APPLYING ROOFING SHINGLES

[76] Inventor: Nicholas J. Rohner, Delhi, N.Y. 13753

[21] Appl. No.: 442,597

[22] Filed: Nov. 18, 1982

[51] Int. Cl.[3] ..... E04B 1/00

[52] U.S. Cl. ..... 52/748; 52/105

[58] Field of Search ..... 52/105, 543, 553, 518, 52/516, 459, 473, 416, 94, 95, 14, 15, 60, 748

[56] References Cited

U.S. PATENT DOCUMENTS

| | | | |
|---|---|---|---|
| 1,887 | 12/1840 | Docker | 52/459 |
| 1,318,125 | 10/1919 | Zimbelmann | 52/459 |
| 1,592,014 | 7/1926 | Topping | 52/518 |
| 1,898,989 | 2/1933 | Harshberger | 52/518 |
| 1,955,699 | 4/1934 | Moffit | 52/543 |
| 2,135,811 | 11/1938 | Goslin | 52/552 |
| 2,323,230 | 6/1943 | McAvoy | 52/553 |
| 2,419,843 | 4/1947 | Marten | 52/18 |
| 3,903,340 | 9/1975 | Sheperd | 52/518 |
| 4,010,592 | 3/1977 | Nixon | 52/748 |
| 4,194,335 | 3/1980 | Diamond | 52/748 |

FOREIGN PATENT DOCUMENTS

| | | | |
|---|---|---|---|
| 193756 | 4/1919 | Canada | 52/543 |
| 501607 | 4/1954 | Canada | 52/553 |
| 20677 | 12/1917 | France | 52/94 |
| 298438 | 10/1928 | United Kingdom | 52/543 |

*Primary Examiner*—John E. Murtagh
*Assistant Examiner*—Andrew Joseph Rudy
*Attorney, Agent, or Firm*—John Maier, III

[57] ABSTRACT

Methods for applying solid shingles using overlapping joints. The solid shingles are made with a base of either a felt or a fiberglass material covered with asphalt and crushed mineral granules. With each method, the upper portion of each shingle is covered by the next higher row of shingles. In the first method two full shingles in the same course are spaced from one another approximately one-third their length and a half shingle is placed between them. In the second method, full shingles are used except, for first shingles of alternating courses which are half shingles. All shingles overlap and each shingle has both ends either over or under both contiguous shingles in the same course. The third method also uses full shingles but with one end of each shingle beneath one contiguous shingle and the other end above the other contiguous shingle in the same course.

8 Claims, 10 Drawing Figures

METHODS OF APPLYING ROOFING SHINGLES

BACKGROUND OF THE INVENTION

1. Field of the Invention

The present invention relates to roofing shingles and methods of installing them. More particularly, the present invention is directed to a roofing shingle of the solid type usually made from either felt or fiberglass but with three marks on the portion of the shingle to be covered by the next higher row of shingles to indicate the center point as well as the one-third and two-third locations from either end. The three marks are substantially as long as the upper portion of the shingle which is covered by the next higher row of shingles. The upper portion is approximately fifty-five percent of the total shingle width. Two additional linear marks, preferably shorter in length are located substantially two inches from each end of the shingle to designate overlap. Included are a variety of methods for installation of such shingles creating a variety of appearances but always with overlapping joints to provide absolute double shingle coverage thereby avoiding joint leaks due to expansion. Accordingly, the general objects of the present invention are to provide a novel and improved shingle and improved methods for installing such shingles.

2. Description of the Prior Art

For a long time in the past, shingles were made with various cut out configurations to give the general appearance of a slate roof. Although such cut outs provided a desirable appearance, the cut outs provided wear spots in the roof where leaks would occur earlier than where a double layer of roofing existed. Therefore, solid shingles without cut outs have been made available. Such solid shingles generally have a rectangular form and are thirty-six inches in length by twelve inches in width. Also a slighter larger shingle is available in metric dimensions.

Shingles expand and contract due to temperature changes and if the shingles are placed too close together in an abutting arrangement, the shingles will buckle in hot weather. As is well known, once shingles buckle they stay buckled even though the temperature drops leaving a permanent leak situation. Even apart from leaks, buckling and cracking detract from the general appearance of the roof. On the other hand, if they are too far apart, when contraction occurs in cold weather, leaks will ultimately develop. It should also be recognized that even with solid shingles, each butt joint still in essence is a cutout resulting in single layer coverage at that point. Therefore, it is desirable to apply such shingles in arrangements which are attractive and which prevent leaks due to contraction and expansion and to improve the shingle itself for easy, reliable installation.

The novel features which are considered as characteristics of the invention are set forth with particularity in the appending claims. The invention itself, however, as to its construction and obvious advantages, will best be understood from the following description of the specific embodiment when read with the accompanying drawings.

SUMMARY OF THE INVENTION

The present invention overcomes the disadvantages of the prior art and in so doing provides an attractive, reliable and durable form of installation of a shingle roof and provides a shingle which makes such installation easier. Each shingle is of solid construction. On the upper portion of each shingle, that is to say, the portion to be covered by the shingle directly above it, there are located three marks or lines to indicate the center point of each shingle and the one-third and two-third location. Two shorter linear marks are also provided on the upper portion of each shingle about two inches from the minor edges of the shingle.

The first method of installing solid roof shingles starts the first course with either a full shingle or a one-third full length shingle. In either event, whichever length of shingle starts the first course, the opposite is used for the second course and the same is used for the third course and this sequence is followed thereafter. The first and third shingles of each course are aligned with one another and placed apart from one another one-third the length of a full shingle. A one-half length shingle is then placed between the first and third shingle with both ends either over or under the first and third shingles.

In the second method, the first course is started with either a full shingle or a half shingle or a half shingle and each successive course alternates with the first shingle being either a full shingle or a half shingle. In every course each successive shingle is a full shingle and each successive shingle in each course alternates between having both ends over and both ends under both contiguous shingles. The first course uses one alternating form of lapping and the second and third course use the opposite form of lapping while the fourth and fifth course return to the lapping pattern of the first course.

The third method starts each course with any random length shingle except that the first shingle of any two successive courses must differ in length by at least six inches. All shingles in all courses thereafter are full shingles with one end under one contiguous shingle and the other end over the other contiguous shingle.

DESCRIPTION OF THE DRAWINGS

The present invention may be better understood and its numerous advantages will become apparent to those skilled in the art by reference to the accompanying drawings wherein like reference numerals refer to like elements in the various figures in which.

DETAILED DESCRIPTION OF THE INVENTION

Figure 1:
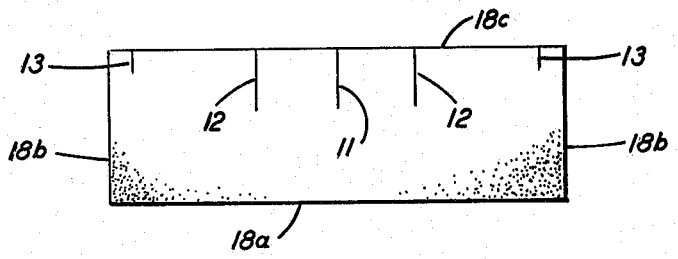
FIG. 1 is a plan view of a shingle showing the lines or marks for easy installation.

Referring to FIG. 1 there is shown a standard shingle which is the British system of measurement has a width of twelve inches and a length of thirty-six inches. A metric size is also available and is just slightly larger. Regardless of whether the shingle is built to British or metric dimensions, construction lines are placed at the upper portion of the shingle, that is to say the portion to be covered by the next higher course of shingles. Such a shingle is normally made of either a felt or a fiberglass base and is covered by asphalt coating and crushed mineral granules. One line 11 is located in the middle of the shingle and the other two lines 12 are located at points one-third and two-thirds from opposite ends of the shingle. The lines 11 and lines 12 may be imposed by a slight indentation in the shingle or by a coloration being applied to it, as for example by paint. The advantages of such a shingle, however, are most apparent when used with the methods of installation also described herein. However, as the methods point out, one-third and two-third length shingles as well as one-half length shingles play a vital role in certain of the various methods. The lines 11 and lines 12 permit ready cutting of the shingles to exact size in a fast and easy manner. The one-third and two-third lines 12 also are frequently the place where nailing is to take place. In addition to the line 11 and the lines 12, two lines 13 are located approximately two inches from the ends of the shingle. The lines 13 are shorter than the line 11 and the lines 12 and the lines 13 serve to show proper overlap distance in some of the methods.

Figure 2:
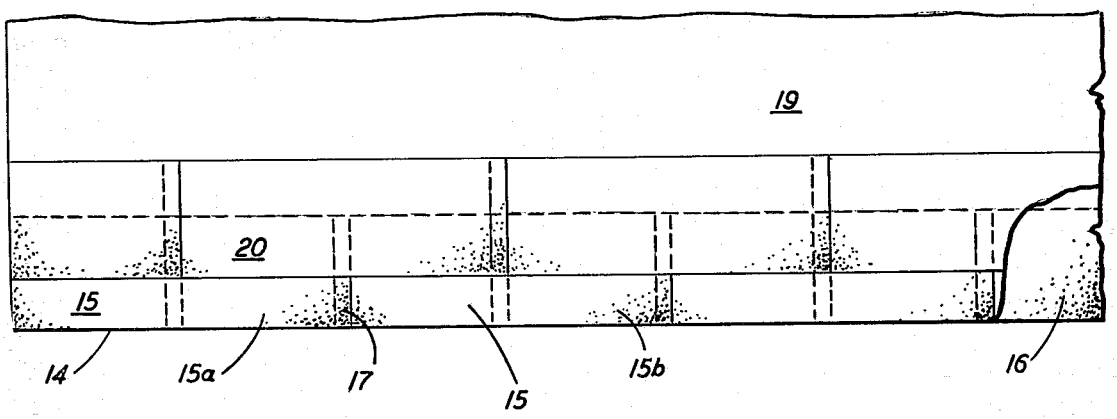
FIG. 2 is a perspective view showing general features of a roof using a shingle as shown in FIG. 1.

As is shown in FIG. 2, shingles are normally started at the lower edge 14 of a roof and are installed course by course until the top of the roof is reached. A first full course 15 is applied along the bottom or lower edge 14 preferably starting with the left hand side 15 of the roof as the installor faces the roof.

Before the first course 15 is installed, a subcourse 16 must first be installed to assure a double thickness of material at the lower portion of the first course 15. The subcourse 16 is started with a shingle of a different length than the first course 15 but the subcourse 16 is installed in the same manner as the first course 15 except that where alternate courses have an alternating overlap pattern 17, as is subsequently explained herein, the first course 15 has an alternate form of overlap from the subcourse 16.

Singles of various possible sizes are then used to complete the first course 15 and the last shingle (not shown) is cut to fit the remaining space. Another contiguous course 20 is then placed over and above the first course 15 with the lower edge of the upper course extending down slightly more than half of the width of the shingles in the earlier course. In the British system, with a twelve inch wide shingle, five inches is left exposed below the next upper course with seven inches covered by the upper course.

In each course, the shingles must join one another. According to this invention a butt joint is never used but rather always an overlap joint is used. Thus, as is seen in FIG. 2, in the first course 15, the first shingle **15*a* and the second shingle 15*b* overlap one another forming the overlap pattern 17. In all the methods hereinafter described, the overlap 17 is increased in dimension in the first few courses because of ice build up during cold weather along the lower edge 14** of the roof. Obviously, this added requirement is not necessary in climates where freezing temperatures are not common.

Each of the shingles is rectangular and has two major edges **18*a* and two minor edges 18*b***.

FIRST METHOD OF INSTALLATION

Figure 3A:
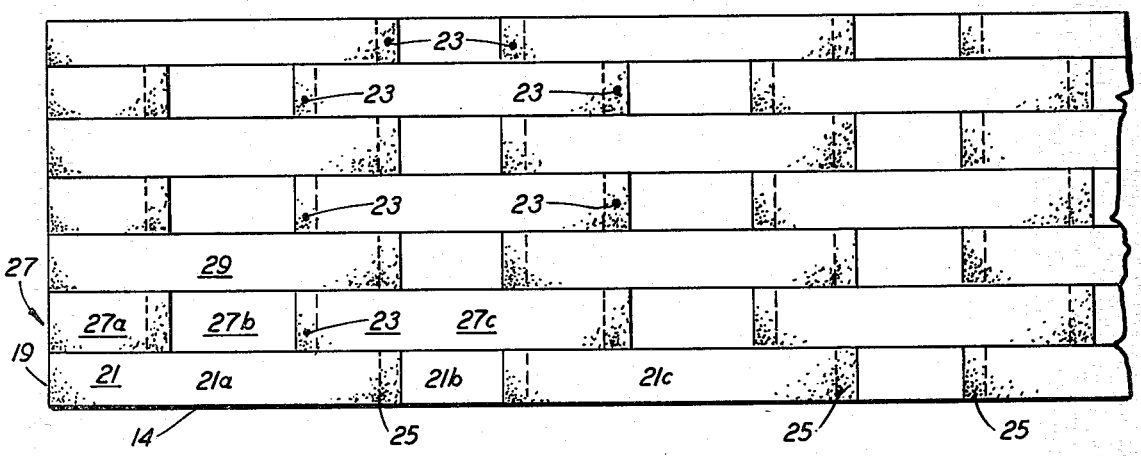
FIG. 3*a* is a plan view showing a first method of installation of the shingle shown in FIG. 1.
Figure 3B:
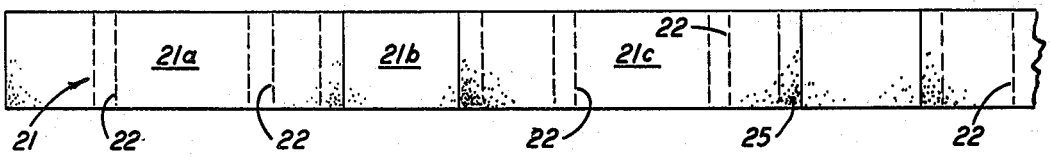
FIG. 3*b* is a plan view of the first course shown in FIG. 3*a* with the subcourse shown in italics.

According to this method, shown in FIGS. **3*a*, 3*b* and 3*c*, a first course 21 of shingles is started by placing a first shingle 21*a* of the first course 21 along the lower edge 14 of the roof, preferably starting at the left hand side 19 as the installor faces the roof. The first shingle 21*a* is either a full shingle or a one-third shingle but never a half shingle. A subcourse 22, shown only by dotted lines, (FIG. 3*b***) would first be installed as has been previously described.

A third shingle **21*c* is then placed twelve inches away from the first shingle 21*a* leaving a twelve inch space (one-third the length of a shingle) between the first shingle 21*a* and third shingle 21*c*. Then a shingle is cut in half to form a second shingle 21*b* and the second shingle 21*b* is installed between the first shingle 21*a* and the third shingle 21*c* with the ends of the half or second shingle 21*b* underneath the ends of both the first shingle 21*a* and the third shingle 21*c*. In cold climates, a two-third shingle would be used for the first few courses to increase the overlap 25 for the reasons already specified. A nail 23 is then applied just above the horizontal center line of the shingle about five inches from the top of a twelve inch shingle. Since the shingle has a length of eighteen inches (one-half of thirty-six inches) in a twelve inch space, there is three inches of overlap 25 on each side. The first course 21 is then continued across the roof until the opposite side of the roof is reached, specifically, with a half shingle between two full shingles and with the ends of the half shingle always underneath the ends of two full shingles to form the overlap 25. The nails 23** are applied as has been previously stated.

The next or second course 27 is then started with a first shingle **27*a* which must be a one-third size shingle. A third shingle 27*c* which must be a full shingle is then applied twelve inches away from the first shingle 27*a*. A one-half shingle is then used for the second shingle 27*b*. All one-half shingles in the second course 27, such as the second shingle 27*b*, are always underneath at the overlap 25 and the full shingle, such as the third shingle 27*c* and the first shingle 27*a*, are always on top at the overlap 25 with the nail 23 installed in the same manner as just described for the first course 21**.

A third course 29 is installed above the second course 27 in the same manner as the first course 21. Of course, the same method can be utilized but with each and every overlap 25 the opposite of that described.

It can be readily seen that since half shingles are frequently used in this method, the line 11 on each shingle makes the cutting operation fast and certain without need for measurement with a ruler. The lines 12 also serve for nailing (not shown) between the laps of full shingles. The lines 13, however, are not utilized in this method. This first method uses approximately eight percent more material for a roof than the methods subsequently to be described but an outstaneding appearance and exceptional security from leaks is achieved.

FIG. **3*c* shows the subcourse 22 and the first three courses 21, 27, 29 separated from one another for clarity. This view differs from FIG. 3*a* and FIG. 3*b* in that the subcourse 22 and the first course 21 are constructed for icy conditions with a double or six-inch overlap 25** while the second course 27 and third course 29 have only the usual or three-inch overlap 25. The number of courses starting at the lower edge 14 of the roof requiring the double overlap is optional depending upon conditions.

Figure 3C:
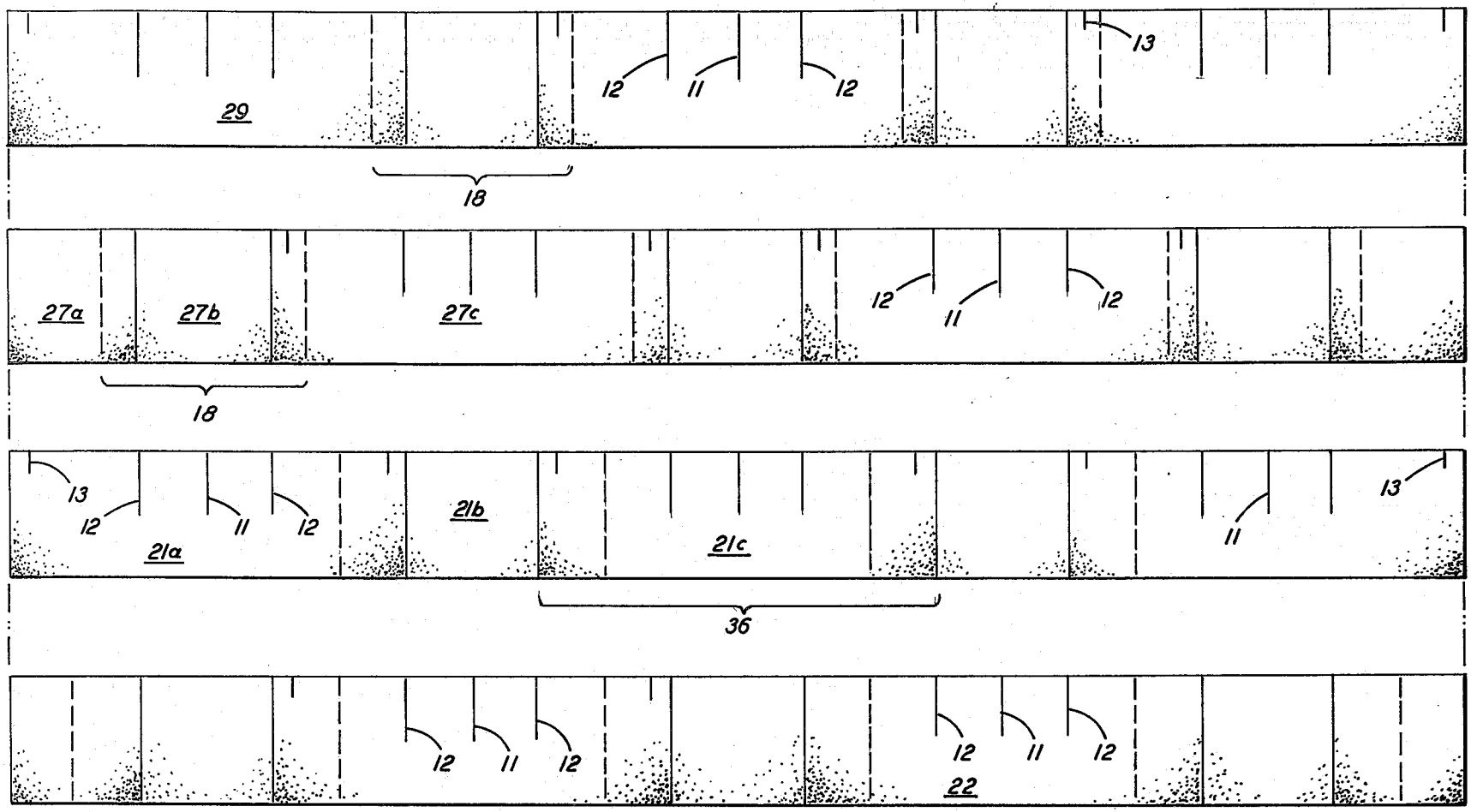
FIG. 3*c* is an exploded plan view of the first method showing the subcourse and the first three courses of shingles to illustrate the advantage of the marks on the shingle in aligning the successive courses.

As FIG. 3c makes clear, regardless of which overlap 25 is used, the lines 12 of the next higher course always align with the butt ends at the overlaps 25. Therefore with course 21 in place, the first shingle 27a of the second course 27 would come to the first mark 12. The third shingle 27c of the second course 27, would start at the second mark 12 of the first shingle 21a. Thus, it can be seen that the marks 12 serve a vital function in speedily and accurately applying a roof according to this invention.

SECOND METHOD OF INSTALLATION

Figure 4A:
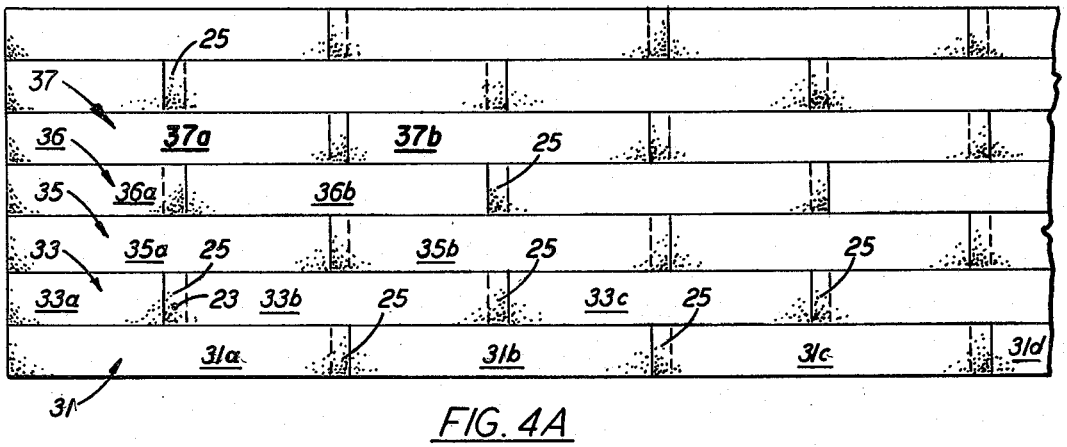
FIG. 4*a* is a plan view showing a second method of installation of the shingle shown in FIG. 1.
Figure 4B:
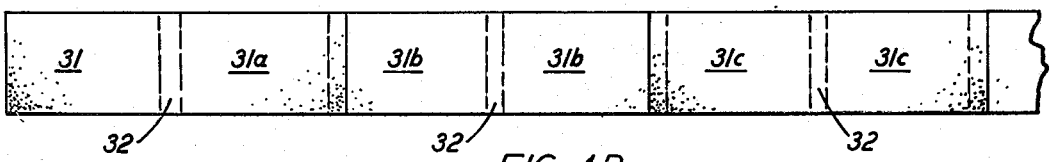
FIG. 4*b* is a plan view of the first course shown in FIG. 4*a* with the subcourse shown in italics.

According to this method, shown in FIG. 4a and 4b, full shingles are used as much as possible. The first course 31 is started with a full shingle as the first shingle 31a. As previously stated, a subcourse 32, shown only by dotted lines in FIG. 4b, would first be placed beneath the first course 31. Full shingles are used all the way across until the other end of the roof is reached. Thus, the second shingle 31b and the third shingle 31c are all full shingles. At the end of the course, the last shingle 31d might have to be cut to fit depending upon actual roof size. Both ends of alternate shingles are either under or over the contiguous shingle but always both ends of the same shingle are either both under or both on top of its contiguous shingles. In FIG. 4a the first shingle 31a is shown above the second shingle 31b. As to the next course, the same general situation occurs but starting with a half shingle and the alternate of over and under is opposite from the course below it.

Referring again to FIG. 4a, the first shingle 31a used to start the first course 31 is a full shingle. The second shingle 31b is also a full shingle. The contiguous end of the second shingle 31b is placed beneath the end of the first shingle 31a forming a two inch overlap 25. A third shingle 31c is then placed with its contiguous end over the second shingle 31b so that both ends of the second shingle 31b are underneath the first shingle 31a and the third shingle 31c at the overlaps 25. Both ends of the fourth shingle 31d (only partially shown) are beneath its contiguous shingles and both ends of a fifth shingle (not shown) would be above its contiguous shingles. This arrangement is continued throughout the course 31.

In the second course 33, the first shingle 33a is a half shingle but the first shingle 33a is underneath the second shingle 33b at the overlap 25. The second shingle 33b and all further shingles in the course are full shingles, except as may be necessitated by space for the last shingle (not shown). Both ends of the second shingle 33b are on top of the continguous shingles at the overlaps 25 and both ends of the third shingle 33c are underneath the contiguous shingles at the overlap 25. The third course 35 begins with a full shingle 35a and follows the pattern of the second course 32. A fourth course 36 is started with a half shingle 36a and follows the pattern of the first course 31. Thus, the overlap between courses is not alternating except for the first two courses. Thereafter, starting with the second course 32, each two contiguous courses alternate in the same manner. Thus, the first shingle 31a of the first course is on top of the second shingle 31b. The first shingle 33a of the second course 33 is on the bottom of the second shingle 33b. The first shingle 35a of the third course 35 is also on the bottom of the second shingle 35b while the first shingles 36a and 37a of the fourth course 36 and fifth course 37 are on top of their respective second shingles 36b and 37b.

The subcourse 16 for the second method uses an overlap 25, the size of which is set by the two-inch marks 13. The one-third lines 12 are used to indicate the placement of the center nails. Of course with subcourses 16, the nails are placed lower than with later courses in both this method and the other methods.

The half line 11 is used to set the location of both half starter shingles and full shingles. Preferably, when a full shingle is used to start a course, the second shingle, as for example second shingle 35b, is placed first with its end aligned with the half mark 11 of third shingle 33c of the second course 33.

Except for the subcourse 16, the nails 23 are applied by driving each nail 23 approximately forty percent of the way down from the top of the shingle at the middle of each overlap 25 and at the one-third lines 12.

Like the first method, the overlap 25 can be reversed providing all overlaps are reversed as to which shingle is on top and which is beneath its contiguous shingle.

Figure 4C:
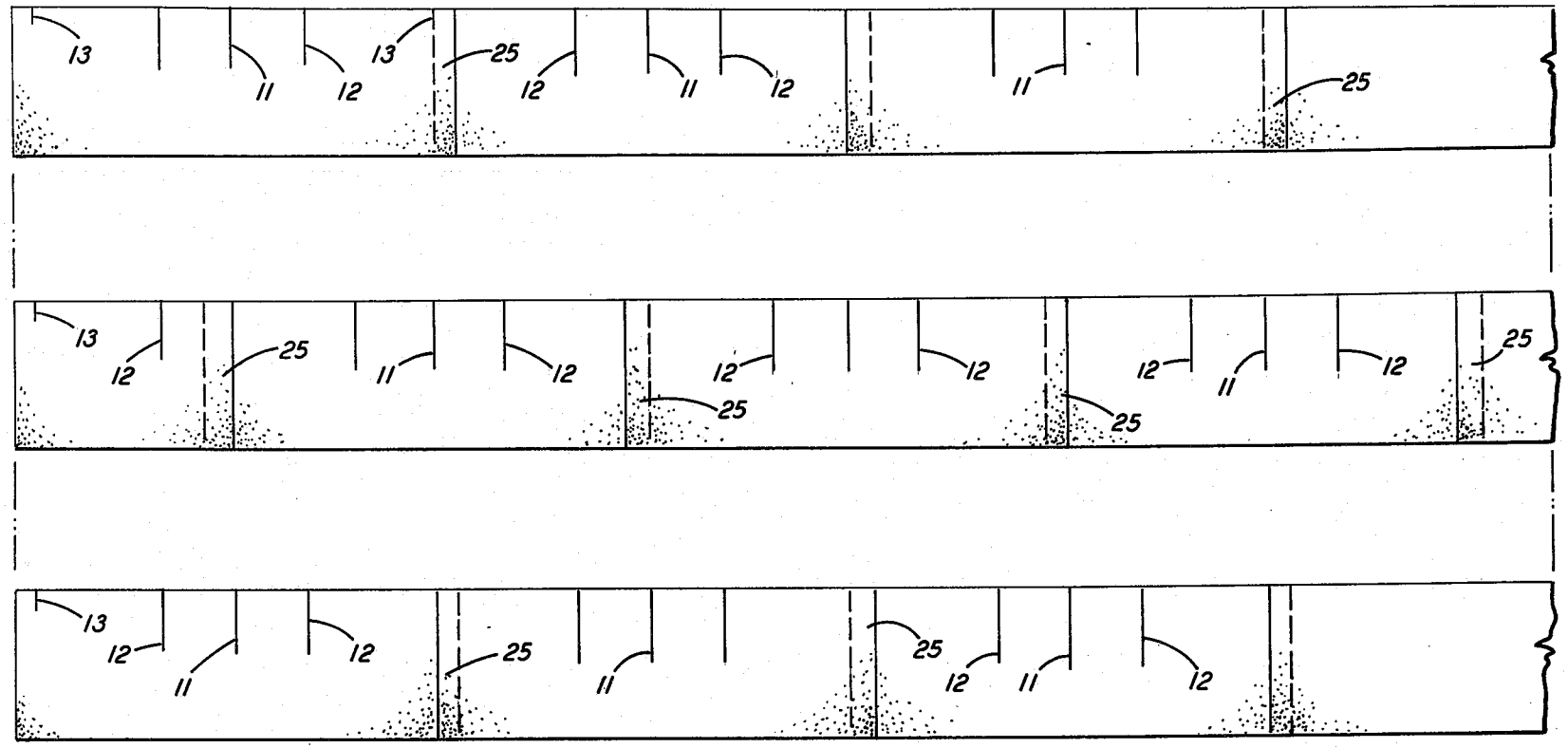
FIG. 4*c* is an exploded plan view of the second method showing the first, second and third course to illustrate the advantage of the marks on the shingle in aligning the successive courses.

It can be readily seen in FIG. 4c that the half point line 11 on each shingle is very advantageous in this method as the second course is brought directly up to the half mark to be applied so as to know exactly where to locate it properly thereby maintaining even joints at all times. The line 11 also serves to cut the half shingles required. The two-inch lines 13 set the overlap 25 without a question. Additional center nailing other than at the overlap 25 would be along the one-third and two-third lines 12.

THIRD METHOD OF INSTALLATION

Figure 5A:
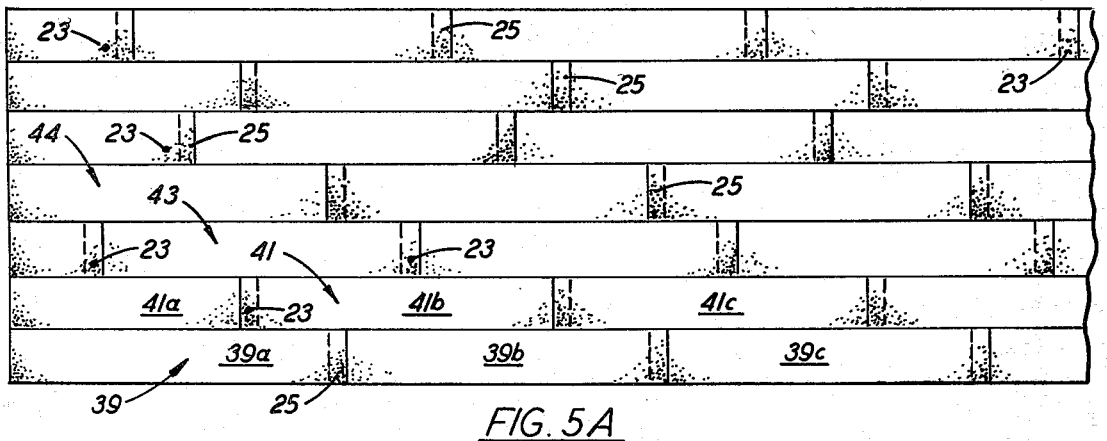
FIG. 5*a* is a plan view showing a third method of installation of the shingle shown in FIG. 1.
Figure 5B:
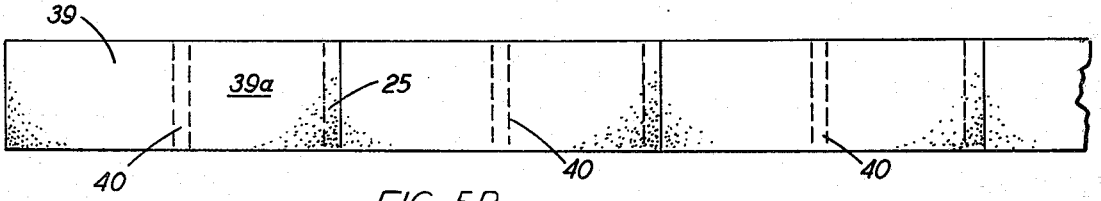
FIG. 5*b* is a plan view of the first course shown in FIG. 5*a* with the subcourse shown in italics.

In this method shown in FIG. 5a and FIG. 5b, like the second method, as many full shingles as possible are used thereby keeping the cutting of shingles to an absolute minimum. The first course 39 is started with a first shingle 39a which can be either a full shingle or a partial shingle. In the example shown in FIG. 5a, a full shingle is shown but any random length could be used to start the course except that at least six inches between joints 25 should be maintained. The first course 39 is, of course, as previously stated, placed over a subcourse 40 shown by dotted lines in FIG. 5b. At the overlap 25, the second shingle 39b can either be over or under the first shingle but in any event each shingle is over at one end and under at the other end. The overlap is always two inches except for the first few courses which, in colder climates, can be increased to three to more inches. Never is any one shingle both on top of both adjoining shingles or under both adjoining shingles.

As best seen in FIG. 5a, the first shingle 39a, by way of example, on top of the second shingle 39b. The second shingle 39b is at the overlap 25 above the third shingle 39c.

In starting a second course 41, the first shingle 41a can be of any length providing it is different from the first course 39. FIG. 5 shows the first course 39 started with a full shingle and the second course started with approximately a three-quarter shingle. The first course 39 could have been started with a one-third shingle and the second course 41 could have been started with a two-thirds shingle or vice versa. The first shingle 41a of the second course is placed underneath the second shingle 41b of the second course 41 at the overlap 25 so as to be opposite from the arrangement of the first course 39. The second shingle 41b is placed underneath the third shingle 41c at the overlap 25.

The third course 43 alternates the overlaps 25 exactly as the first course 39 and is started with another random shingle 43a which could be a full shingle but is shown being started with approximately a one-quarter single. The fourth course 44 alternates overlaps exactly as the second course 41 and is started with still another random shingle as was the second course 41. In other words, each course reverses the overlaps from the course directly before it.

In this method, location of the nails 23 is important. If the next shingle in any course is to be under the shingle being installed drive the nail at that end, inside the end enough to permit the next shingle to be installed underneath with approximately a two-inch overlap 25. However, if the next shingle is to be over at the overlap 25, place the nail 23 at the very end of the shingle being installed. Theoretically, each course can be started with a shingle of a different size providing two contiguous courses do not start with a shingle of the same size.

The third method is the fastest of all the methods. Cutting is kept to an absolute minimum and precision is not required. The last piece of a course can be cut too long and the size of the overlap merely be increased thus eliminating cutting even at the end of the course.

The lines 13 assist in the overlap since one end of one shingle is probably intact to serve as a guide. The line 11 and the lines 12 has less application to this method than to the others except that center nailing (not shown) would be at the one-third and two-third lines 12.

While a preferred embodiment has been shown and described, various modifications and substitutions may be made without departing from the spirit and scope of this invention. Accordingly, it is understood that this invention has been described by way of illustration rather than limitation.

I claim:

1. A method of applying solid roof singles of rectangular shape to the roof of a structure, each shingle having two minor edges and two major edges and an upper portion to be located remotely from the lower edge of the roof, said method comprising:

placing a first solid roof shingle in a first course with a major edge of the shingle along the lower edge of a roof with a minor edge of the shingle abutting a side edge of the roof;

placing a third solid roof shingle in the first course along the lower edge of the roof aligned with the first shingle, said third solid roof shingle being of full length, the first shingle and the third shingle being spaced from one another a distance of substantially one-third the length of a shingle of full length;

placing a second solid roof shingle in the first course along the lower edge of the roof aligned with both the first shingle and the third shingle, said second solid roof shingle having a length of substantially one-half the length of a shingle of full length, an overlap being formed between said first shingle and said second shingle and another overlap being formed between said third shingle and said second shingle, both of said overlaps being substantially equal;

inserting a nail through the overlap of the first and second shingles and a nail through the overlap of the second and third shingles, each nail being inserted in the upper portion of the shingles remote from the lower edge of the roof;

placing a first solid roof shingle in a second course overlapping the upper portion of the first course, said first solid shingle in the second course abutting the same side edge of the roof as the first shingle of the first course;

placing a third solid roof shingle in the second course overlapping the upper portion of the first course and aligned with the first shingle of the second course, said third solid roof shingle of the second course being of full length, the first shingle and the third shingle of the second course being spaced from one another a distance of substantially one-third the length of a shingle of full length;

placing a second solid roof shingle in the second course overlapping the upper portion of the first course aligned with both the first and the third shingle of the second course, said second solid roof shingle having a length of substantially one-half the length of a shingle of full length, an overlap being formed between said first shingle and said second shingle and another overlap being formed between said third shingle and said second shingle, both of said overlaps being substantially equal; and inserting a nail through the overlap of the first and second shingle of the second course and a nail through the overlap of the second and third shingles of the second course, each nail being inserted in the upper portion of the shingles remote from the lower edge of the roof.

2. A method of applying said roof shingles of rectangular shape according to claim 1 wherein the first solid roof shingle being placed in the first course is a solid roof shingle of full length and the first solid roof shingle being placed in the second course is a solid roof shingle of one-third full length.

3. A method of applying solid roof shingles of rectangular shape according to claim 1 wherein the first solid roof shingle being placed in the first course is a solid roof shingle of one-third full length and the first solid roof shingle being placed in the second course is a solid roof shingle of full length.

4. A method of applying solid roof shingles of rectangular shape according to claim 1 wherein the first and third shingles of the first course are placed over the ends of the second shingle of the first course and the first and third shingles of the second course are placed over the ends of the second shingle of the second course.

5. A method of applying solid roof shingles of rectangular shape according to claim 1 wherein the first and third shingles of the first course are placed under the ends of the second shingle of the first course and the first and third shingles of the second course are placed under the ends of the second shingle of the second course.

6. A method of applying solid roof shingles of rectangular shape to the roof of a structure, each shingle having two minor edges and two major edges and an upper portion to be located remotely from the lower edge of the roof, said method comprising:

placing a first solid roof shingle of full length in a first course with a major edge of the shingle along the lower edge of a roof with a minor edge of the shingle abutting a side edge of the roof;

placing a second solid roof shingle of full length in the first course aligned with the first shingle in the first course;

placing a third solid roof shingle of full length in the first course aligned with the first and second shingles, the first shingle and third shingle being lapped at their minor edges with the second shingle and with the second shingle under the first and third shingles at their minor edges;

inserting nails through the overlap of contiguous shingles of the first course, each nail being inserted in the upper portions of the shingles remote from the lower edge of the roof;

placing a first solid roof shingle of one-half full length in a second course overlapping the upper portion of the first course with a minor edge of the shingle abutting a side edge of the roof;

placing a second solid roof shingle of full length in the second course aligned with the first shingle in the second course;

placing a third solid roof shingle of full length in the second course aligned with the first and second shingles in the second course, the first shingle and third shingle of the second course being lapped at their minor edges with the second shingle and with the second shingle over the first and third shingles of the second course at their minor edges;

inserting nails through the overlap of contiguous shingles of the second course, each nail being inserted in the upper portions of the shingles remote from the lower edge of the roof;

placing a first solid roof shingle of full length in a third course overlapping the upper portion of the second course with a minor edge of the shingle abutting a side edge of the roof;

placing a second solid roof shingle of full length in the third course aligned with the first shingle in the third course;

placing a third solid roof shingle of full length in the third course aligned with the first and second shingles in the third course, the first shingle and third shingle of the third course being lapped at their minor edges with the second shingle and with the second shingle over the first and third shingles of the third course at their minor edges;

inserting nails through the overlap of contiguous shingles of the third course, each nail being inserted in the upper portions of the singles remote from the lower edge of the roof;

placing a first solid roof shingle of one-half full length in a fourth course overlapping the upper portion of the third course with a minor edge of the shingle abutting a side edge of the roof;

placing a second solid roof shingle of full length in the fourth course aligned with the first shingle in the fourth course;

placing a third solid roof shingle of full length in the fourth course aligned with the first and second shingles in the fourth course, the first shingle and third shingle of the fourth course being lapped at their minor edges and with the second shingle under the first and third shingles of the fourth course at their minor edges;

inserting nails through the overlap of contiguous shingles of the fourth course, each nail being inserted in the upper portions of the shingles remote from the lower edge of the roof;

placing a first solid roof shingle of full length in a fifth course overlapping the upper portion of the first course with a minor edge of the shingle abutting a side edge of the roof;

placing a second solid roof shingle of full length in the fifth course aligned with the first shingle in the fifth course;

placing a third solid roof shingle of full length in the fifth course aligned with the first and second shingles in the fifth course, the first shingle and third shingle of the fifth course being lapped at their minor edges with the second shingle and with the second shingle under the first and third shingles of the fifth course at their minor edges; and inserting nails through the overlap of contiguous shingles of the fifth course, each nail being inserted in the upper portions of the shingles remote from the lower edge of the roof.

7. A method of applying solid roof shingles of rectangular shape to the roof of a structure, each shingle having two minor edges and two major edges and an upper portion to be located remotely from the lower edge of the roof, said method comprising:

placing a first solid roof shingle of any random length in a first course with a major edge of the shingle along the lower edge of the roof with a minor edge of the shingle abutting a side edge of the roof;

placing a second solid roof shingle of full length in the first course aligned with the first shingle, said second solid roof shingle overlapping said first solid roof shingle at one minor edge with said second shingle being above said first shingle;

placing a third solid roof shingle of full length in the first course aligned with the first and second shingles, said third shingle overlapping said second solid roof shingle at one minor edge with said third shingle being above said second shingle;

placing a fourth solid roof shingle of full length in the first course aligned with the first and second and third shingles, said fourth shingle overlapping said third solid roof shingle at one minor edge with said fourth shingle being above said third shingle;

inserting nails through the overlap of contiguous shingles of the first course, each nail being inserted in the upper portions of the shingles remote from the lower edge of the roof;

placing a first solid roof shingle in the second course overlapping the upper portion of the first course with a minor edge of the first shingle abutting the side edge of the roof, said first solid roof shingle of the second course having any random length differing from the length of the first shingle of the first course by at least six inches;

placing a second solid roof shingle of full length in the second course aligned with the first shingle of the second course, said second solid roof shingle overlapping said first solid roof shingle of the second course at one minor edge with said second shingle being beneath said first shingle;

placing a third solid roof shingle of full length in the second course aligned with the first and second shingles, said third shingle overlapping said second solid roof shingle at one minor edge with said third shingle being beneath said second shingle;

placing a fourth solid roof shingle of full length in the second course aligned with the first and second and third shingles, said fourth shingle overlapping said third solid roof shingle at one minor edge with said fourth shingle being beneath said third shingle;

inserting nails through the overlap of contiguous shingles of the second course, each nail being inserted in the upper portion of the shingles remote from the lower edge of the roof;

placing a first solid roof shingle in the third course overlapping the upper portion of the second course with a minor edge of the first shingle abutting the side edge of the roof, said first solid roof shingle of the second course having any random length differing from the length of the first shingle of the second course by at least six inches;

placing a second solid roof shingle of full length in the third course aligned with the first shingle, said second solid roof shingle of the third course overlapping said first solid roof shingle of the third course at one minor edge with said second shingle being above said first shingle;

placing a third solid roof shingle of full length in the third course aligned with the first and second shingles, said third shingle overlapping said second solid roof shingle at one minor edge with said third shingle being above said second shingle of the third course;

placing a fourth solid roof shingle of full length in the third course aligned with the first and second and third shingles of the third course, said fourth shingle overlapping said third solid roof shingle at one minor edge with said fourth shingle being above said third shingle of the third course;

inserting nails through the overlap of contiguous shingles of the third course, each nail being inserted in the upper portion of the shingles remote from the lower edge of the roof;

placing a first solid roof shingle in the fourth course overlapping the upper portion of the third course with a minor edge of the first shingle abutting the side edge of the roof, said first solid roof shingle of the fourth course having any random length differing from the length of the first shingle of the third course by at least six inches;

placing a second solid roof shingle of full length in the fourth course aligned with the first shingle of the fourth course, said second solid roof shingle overlapping said first solid roof shingle of the fourth course at one minor edge with said second shingle of the fourth course being beneath said first shingle of the fourth course;

placing a third solid roof shingle of full length in the fourth course aligned with the first and second shingles of the fourth course, said third shingle of the fourth course overlapping said second solid roof shingle of the fourth course at one minor edge with said third shingle of the fourth course being beneath said second shingle of the fourth course;

placing a fourth solid roof shingle of full length in the fourth course aligned with the first and second and third shingles of the fourth course, said fourth shingle of the fourth course overlapping said third solid roof shingle of the fourth course at one minor edge with said fourth shingle of the fourth course being beneath said third shingle of the fourth course; and inserting nails through the overlap of contiguous shingles of the fourth course, each nail being inserted in the upper portion of the shingles remote from the lower edge of the roof.

8. A method of applying solid roof shingle of rectangular shape to the roof of a structure, each shingle having two minor edges and two major edges and an upper portion to be located remotely from the lower edge of the roof, said method comrising:

placing a first solid roof shingle of any random length in a first course with a major edge of the shingle along the lower edge of the roof with a minor edge of the shingle abutting a side edge of the roof;

placing a second solid roof shingle of full length in the first course aligned with the first shingle, said second solid roof shingle overlapping said first solid roof shingle at one minor edge with said second shingle being beneath said first shingle;

placing a third solid roof shingle of full length in the first course aligned with the first and second shingles, said third shingle overlapping said second solid roof shingle at one minor edge with said third shingle being beneath said second shingle;

placing a fourth solid roof shingle of full length in the first course aligned with the first and second and third shingles, said fourth shingle overlapping said third solid roof shingle at one minor edge with said fourth shingle being beneath said third shingle;

inserting nails through the overlap of contiguous shingles of the first course, each nail being inserted in the upper portion of the shingle remote from the lower edge of the roof;

placing a first solid roof shingle in the second course overlapping the upper portion of the first course with a minor edge of the first shingle abutting the side edge of the roof, said first solid roof shingle of the second course having any random length differing from the length of the first shingle of the first course by at least six inches;

placing a second solid roof shingle of full length in the second course aligned with the first shingle of the second course, said second solid roof shingle overlapping said first solid roof shingle of the second course at one minor edge with said second shingle being above said first shingle;

placing a third solid roof shingle of full length in the second course aligned with the first and second shingles, said third shingle overlapping said second solid roof shingle at one minor edge with said third shingle being above said second shingle;

placing a fourth solid roof shingle of full length in the second course aligned with the first and second and third shingles, said fourth shingle overlapping said third solid roof shingle at one minor edge with said fourth shingle being above said third shingle;

inserting nails through the overlap of contiguous shingles of the second course, each nail being inserted in the upper portions of the shingles remote from the lower edge of the roof placing a first solid roof shingle in the third course overlapping the upper portion of the second course with a minor edge of the first shingle abutting the side edge of the roof, said first solid roof shingle of the second course having any random length differing from the length of the first shingle of the second course by at least six inches;

placing a second solid roof shingle of full length in the third course aligned with the first shingle, said second solid roof shingle of the third course overlapping said first solid roof shingle of the third course at one minor edge with said second shingle being beneath said first shingle;

placing a third solid roof shingle of full length in the third course aligned with the first and second shingles, said third shingle overlapping said second solid roof shingle at one minor edge with said third shingle being beneath said second shingle of the third course;

placing a fourth solid roof shingle of full length in the third course course aligned with the first and second and third shingles of the third course, said fourth shingle overlapping said third solid roof shingle at one minor edge with said fourth shingle being beneath said third shingle of the third course;

inserting nails through the overlap of contiguous shingles of the third course, each nail being inserted in the upper portion of the shingles remote from the lower edge of the roof;

placing a first solid roof shingle in the fourth course overlapping the upper portion of the third course with a minor edge of the first shingle abutting the side edge of the roof, said first solid roof shingle of the fourth course having any random length differing from the length of the first shingle of the third course by at lest six inches;

placing a second solid roof shingle of full length in the fourth course aligned with the first shingle of the fourth course, said second solid roof shingle of the fourth course overlapping said first solid roof shingle of the fourth course at one minor edge with said second shingle being above said first shingle of the fourth course;

placing a third solid roof shingle of full length in the fourth course aligned with the first and second shingles of the fourth course, said third shingle of the fourth course overlapping said second solid roof shingle of the fourth course at one minor edge with said third shingle being above said second shingle of the fourth course;

placing a fourth solid roof shingle of full length in the fourth course aligned with the first and second and third shingles of the fourth course, said fourth shingle of the fourth course overlapping said third solid roof shingle of the fourth course at one minor edge with said fourth shingle of the fourth course being above said third shingle of the fourth course; and inserting nails through the overlap of contiguous shingles of the fourth course, each nail being inserted in the upper portion of the shingles remote from the lower edge of the roof.

* * * * *